United States Patent [19]

Valentine

[11] 4,046,243

[45] Sept. 6, 1977

[54] DISPOSABLE DIAPER DISPENSER VENDING UNIT

[76] Inventor: Sandra Valentine, R.R. No. 1, Norland, Ontario, Canada

[21] Appl. No.: 711,119

[22] Filed: Aug. 3, 1976

[51] Int. Cl.[2] ..... G07F 11/52

[52] U.S. Cl. ..... 194/10; 221/76; 221/102

[58] Field of Search ..... 221/92, 93, 97, 69, 221/129, 83, 130, 102, 82, 79, 76, 155, 150 HC; 194/2, 10; 222/239-241

[56] References Cited

U.S. PATENT DOCUMENTS

| | | | |
|---|---|---|---|
| 1,619,006 | 3/1927 | Vaughan | 221/130 X |
| 3,107,815 | 10/1963 | Wittenborg | 221/76 |

*Primary Examiner*—Stanley H. Tollberg
*Attorney, Agent, or Firm*—Robert D. Farkas

[57] ABSTRACT

A diaper dispensing vending unit includes a housing having an upper, middle, and lower chambers therein. The upper and middle chambers each contain a drum type dispensing assembly therein, wherein one assembly dispenses disposable diapers and the other assembly dispenses plastic bags. The lower chamber has a bin door in a front face of the housing allowing used diapers and bags to be placed into a bin contained in the lower chamber.

8 Claims, 6 Drawing Figures

DISPOSABLE DIAPER DISPENSER VENDING UNIT

SUMMARY OF THE INVENTION

My present invention relates to a unit and novel vending unit designed to dispense diapers and plastic bags as well as to receive for storage used diapers and plastic bags.

A primary object of my present invention is to provide a means for dispensing one at a time either a plastic bag or a disposable diaper.

Another object of my present invention is to provide a means for storing the used diapers or plastic bags.

A still further object of my present invention is to provide a means for deodorizing said storage unit.

Briefly, my present invention comprises a housing having an upper, middle and lower chambers therein. The upper and middle chambers each contain a drum type dispensing assembly therein, wherein one assembly dispenses disposable diapers and the other assembly dispenses plastic bags. The lower chamber has a bin door in a front face of the housing allowing used diapers and bags to be placed into a bin contained in the lower chamber.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
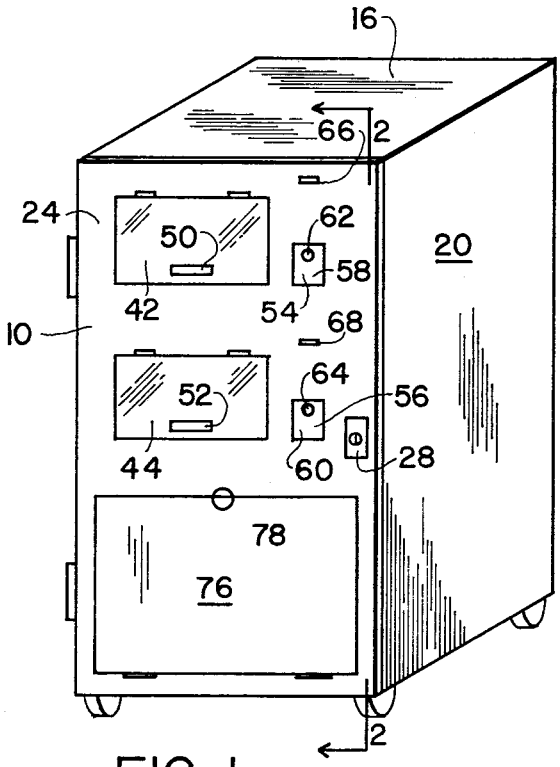
FIG. 1 illustrates a perspective view of the vending unit.
Figure 2:
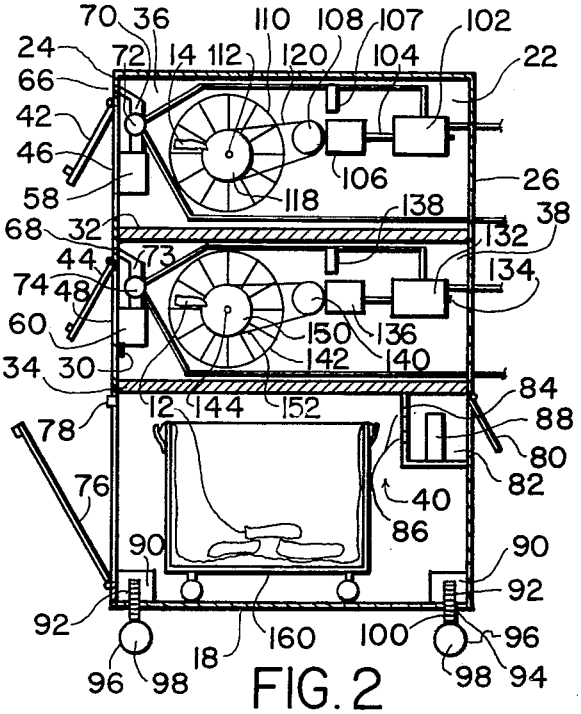
FIG. 2 illustrates a side crosssectional view of the vending unit.
Figure 4:
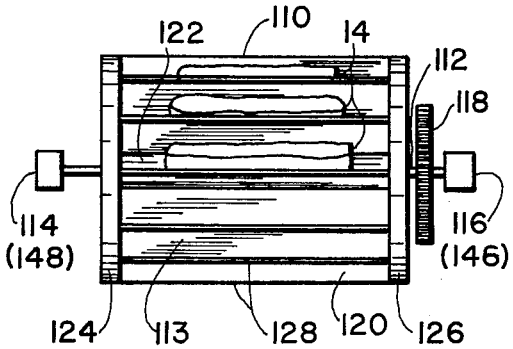
FIG. 4 illustrates a top partial cutaway view of a disposable diaper.
Figure 5:
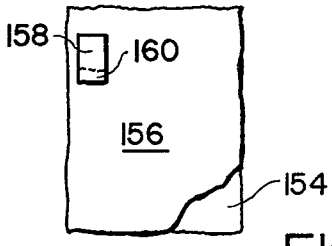
FIG. 5 illustrates a front view of a drum type dispensing assembly.
Figure 6:
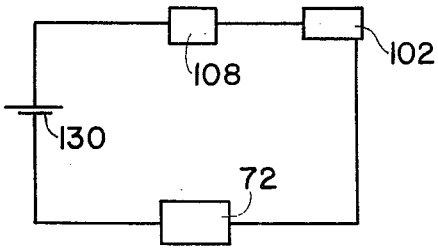
FIG. 6 illustrates a schematic diagram of a circuit of the vending unit.

Turning now descriptively to the drawings, in which similar reference characters denote similar elements throughout the several views, FIGS. 1 and 2 show a disposable diaper dispenser vending unit 10 designed to dispense disposable diaper 12, plastic bags 14 for receiving used diapers 12 therein, and a receptactle for storing the bags 14 having the used diapers 12 therein. The unit 10 comprises a rectangularly shaped housing 16 having a base 18, a pair of upwardly extending sidewalls 20, 22 an upwardly extending front wall 24 that is hingably mounted to the front vertical edge of one sidewall 20, and an upwardly extending rear wall 26. The front wall 24 has a lock mechanism 28 therein, wherein said mechanism 28 communicates with a lock bar 30 mounted on an interior surface of the other sidewall 22. Two horizontally placed shelves 32, 34 divided the interior of the housing 16 into an upper chamber 36, a middle chamber 38, and a lower chamber 40. A pair of transparent doors 42, 44 are hingably mounted in a pair of apertures 46, 48 in the front wall 24, wherein each door 42, 44 has a handle member 50, 52 thereon. One door 42 is positioned so as to communicate with the upper chamber 36 and the other door 44 is positioned so as to communicate with the middle chamber 38. The front wall 24 also has a pair of rectangularly shaped openings 54, 56 therein, wherein one opening 54 communicates with the upper chamber 36 and the other opening 56 communicates with the middle chamber 38. Rectangularly shaped open top coin boxes 58, 60 are slidably contained in each opening 54, 56 wherein each opening 54, 56 has a lock member 62, 64 therein. The front wall 24 has a pair of coin slots 66, 68 therein, wherein one slot 66 communicates with a first coin chute 70 positioned in the upper chamber 36, wherein chute 70 terminates in box 58. A first electro-mechanical coin counter mechanism 72 is disposed in chute 70. The other slot 68 communicates a second coin chute 73 positioned in the middle chamber 38, wherein chute 73 terminates in box 60. A second electro-mechanical coin counter mechanism 74 is disposed in chute 73. The front wall 24 also has a bin door 76 therein, wherein the bin door 76 has a coin lock 78 therein and communicates with the lower chamber 40. The rear wall 26 has a door 80 therein, wherein door 80 communicates with a compartment 82 in lower chamber 40. The walls 84 of compartment 82 has ventilation holes 86 therethrough. The compartment 82 is adapted to receive a deodorizer 88 therein. The lower compartment 40 has at each bottom corner a vertical block member 90, each member 90 has a center threaded bore 92 therethrough. The bore 92 of each member 90 aligns with one of a plurality of openings 94 in the base of the housing 16. A plurality of self leveling wheel member 96 are provided, wherein each member 96 includes a wheel 98 rotatably mounted onto an end of an externally threaded rod 100 which threadably engages upwardly into bore 92 of member 90. A first electric motor 102 having a drive shaft 104 is contained in the upper chamber 36. A first clutch assembly 106 communicates with the drive shaft 104. The clutch assembly 106 mechanically communicates with a first solenoid 107. The clutch assembly 106 mechanically communicates with a small tooth gear 108. A first drum type dispenser assembly 110 is mounted for rotation on a shaft 112 which is journalled for rotation in pillow bearing blocks 114, 116 as shown in FIG. 5. A large tooth gear 118 is mounted on shaft 112. A chain member 120 joins gears 108, 118 together. The dispenser assembly 110 consists of a horizontally placed drum 120 having a center hub 122 and end disc portions 124, 126 wherein shaft 112 extends through hub 122. A plurality of dividers 128 extend outwardly from the center hub 122, wherein the dividers 128 are equally spaced around the periphery of the hub 122. Each divider 128 extends from one disc portion 124 to the other disc portion 126. In each space 113 formed between two dividers 128 is placed a disposable plastic bag 14. A first electric series circuit as shown in FIG. 6 consists essentially of the first electro-mechanical coin counter mechanism 72, the first electric motor 102, the first solenoid 108, and a power source 113. In the middle chamber 38 is contained a second electric motor 132 having a drive shaft 134. A second clutch assembly 136 communicates with shaft 134. The assembly 136 mechanically communicates with a second solenoid 138. The clutch assembly 136 mechanically communicates with a small tooth gear 140. A second drum type dispenser assembly 142 of identical construction to dispenser assembly 110 is mounted for rotation on a shaft 144 which is journalled for rotation in pillow bearing blocks 146, 148 as shown in FIG. 5. A large tooth gear 150 is mounted on shaft 144. A chain member 152 joins gears 140, 150 together. Disposable diapers 12 are contained for dispensing in assembly 142. Each diaper 12 as shown in FIG. 4 consists of a composite of an absorbent layer 154 and plastic layer 156, wherein a sealed envelope 158 of a soothing skin ointment 160 is adhesive adhered to the plastic layer 156. A second electric series circuit for the assembly 142 is identical to the first series circuit.

Figure 3:
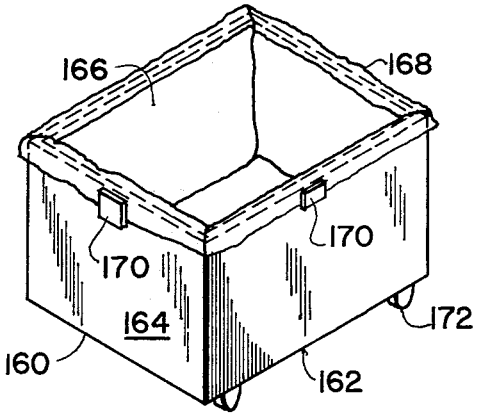
FIG. 3 illustrates a perspective view of a storage bin adapted to be received in the vending unit.

A bin 160 as shown in FIG. 3 is to receive the used diapers 12 and bags is contained in the lower chamber 40. The bin 160 consists of a base 162, four upwardly extending sidewalls 164, and an open top 166. The bin 160 is adapted to receive a trash bag 168 therein, wherein the upper edge of bag 168 is lapped over the upper edges of sidewalls 164. Clip members 170 are provided for securing the bag 168 to the upper edges of the sidewalls 164. Four wheel members 172 are affixed to the base 162 of bin 160 thereby allowing the bin 160 to be rolled in and out of the lower chamber 40.

In use, a diaper 12 or a plastic bag 14 is dispensed by insertion of a coin into the proper coin slot 66, 68. After the use of the diaper 12 or bag 14, a coin is placed into the coin lock 78 thereby allowing the bin door 76 to be open for insert of the used bag 14 or diaper 12 into bin 160. The insert of the coin into the coin slot 66, 68 causes an electrical activation of the series circuit causing the electric motor to be activated as well as the solenoid. The solenoid control the one turn clutch allowing the drum to rotate only a certain number of predetermined degrees. For example, if the drum contains one hundred and twenty spaces between the dividers on the drum, then the clutch will allow the drum to rotate three degrees.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A disposable diaper dispenser vending unit adapted to dispense disposable diapers or plastic bags and to receive for storage said diapers or bags, which comprises:

a. a housing having an upper, a middle, and a lower chamber therein, and a vertically placed front wall, said front wall having a pair of apertures therein, one said aperture communicating with said upper chamber and said other aperture communicating with said lower chamber;

b. a pair of transparent doors having handles thereon, each said door hinged to said front wall within one said aperture;

c. a bin door hinged within said front wall, said bin door communicating with said lower chamber;

d. a bin member contained in said lower chamber, said bin member adapted to receive said used diapers and bags;

e. means for deodorizing said lower chamber;

f. one assembly of a coin slot, coin box, coin chute and electro-mechanical coin counter contained in each said upper and middle chambers;

g. one solenoid contained in each said upper and middle chambers;

h. one said electric motor with associated drive shaft contained in each said upper and middle chambers;

i. a clutch assembly communicating with each said drive shaft, each said solenoid communicating with each said clutch assembly;

j. a drum type dispenser assembly contained in each said upper and middle chamber;

k. each said dispenser assembly mounted for rotation on a shaft;

l. a large tooth gear mounted on each said shaft;

m. a small tooth gear mechanically communicating with each said clutch assembly;

n. a chain joining each said set of said small and large tooth gears; and o. two electric series circuits, each said circuit consisting of one said electric motor, a power source, one said solenoid, and one said electro mechanical coin counter.

2. A unit according to claim 1, wherein each said drum assembly includes a hub having a pair of end discs, and a plurality of dividers arranged around and extending out from a periphery of said hub.

3. A unit according to claim 1, wherein said front wall is hingedly joined to a vertical forward edge of one said sidewall.

4. A unit according to claim 1, wherein said housing has a plurality of self leveling wheels affixed to a base of said housing.

5. A unit according to claim 1, wherein said bin member includes a base, four upwardly extending sidewalls, and an open top, said bin adapted to receive a trash bag therein.

6. A unit according to claim 1, wherein clip members are provided for securing said trash bag to said bin member.

7. A unit according to claim 1, wherein each said coin box is slidably contained through an opening in said front wall.

8. A unit according to claim 1, wherein a rear wall of said housing has a door therein, said door communicating with a compartment within said lower chamber, walls of said compartment having ventilation holes therethrough.

* * * * *